United States Patent [19]

Guidry

[11] 4,289,017

[45] Sep. 15, 1981

[54] BODY PULLER

[76] Inventor: Joseph L. Guidry, 334 Innesbrook St., Santa Rosa, Calif. 95401

[21] Appl. No.: 70,091

[22] Filed: Aug. 27, 1979

[51] Int. Cl.[3] ..... B21D 1/12

[52] U.S. Cl. ..... 72/462; 72/705; 72/478

[58] Field of Search ..... 33/168 R, 168 B; 7/138; 72/705, 462, 483, 478; 81/71

[56] References Cited

U.S. PATENT DOCUMENTS

| | | | |
|---|---|---|---|
| 1,879,979 | 9/1932 | Countryman | 72/705 X |
| 2,941,429 | 6/1960 | Mason | 72/705 X |
| 2,949,144 | 8/1960 | Dredske et al. | 72/705 X |
| 3,091,983 | 6/1963 | Kliss | 72/705 X |
| 3,100,336 | 8/1963 | Fannin | 72/705 X |
| 3,641,805 | 2/1972 | Reinke | 72/705 X |
| 4,040,287 | 8/1977 | Wivinis | 72/705 X |
| 4,116,035 | 9/1978 | Malarsky | 72/705 X |

FOREIGN PATENT DOCUMENTS

| | | | |
|---|---|---|---|
| 859177 | 1/1961 | United Kingdom | 81/71 |

*Primary Examiner*—Lowell A. Larson
*Attorney, Agent, or Firm*—Alvin E. Hendricson

[57] ABSTRACT

A tool for straightening metal of automobile bodies and the like or lifting metal sheets has a heavy ring carrying a pair of arms with looped ends about the ring and L-shaped outer ends for insertion through one or more apertures formed in metal to be straightened whereby pulling of the ring automatically turns the outer ends of the arms into desired alignment.

5 Claims, 4 Drawing Figures

BODY PULLER

BACKGROUND OF INVENTION

Sheet metal repair of damaged automobiles may be accomplished in a variety of ways and one manner of removing dents in metal having an inaccessible back side is to drill one or more holes in the metal and insert a tool having a right angle projection on the end so that pulling on the tool forces the metal back toward original shape. Various means are employed to apply a force to such a tool including a "come along" and a "knocker" by which repeated blows may be struck. One of the problems with this manner of removing dents is the tendency of the tool to tear the metal adjacent to the aperture or hole through which the tool is placed. Care must be taken to prevent tearing of the metal and normally the hook element must be continually repositioned. Consequently this type of dent removal is quite tedious and time consuming. Unfortunately, alternatives have been even less advantageous.

The present invention provides for splitting the force applied to a local area of metal in this general manner of dent removal and automatically aligning tool ends on the back side of the metal being operated upon.

SUMMARY OF INVENTION

The present invention comprises a tool for pulling out dents in the metal of automobile bodies and the like, and may also be employed for lifting metal sheets, beams, etc. The tool has two arms with lateral projections on the outer ends thereof and looped inner ends disposed about a ring so that the arms and ring are secured together. The lateral projections of the arms are reversed with respect to each other and thus they automatically align in opposition (toward or away from each other) when inserted in one or more apertures and the ring is pulled.

DESCRIPTION OF FIGURES

The present invention is illustrated as to a single preferred embodiment in the accompanying drawings, wherein.

DESCRIPTION OF PREFERRED EMBODIMENT

Figure 1:
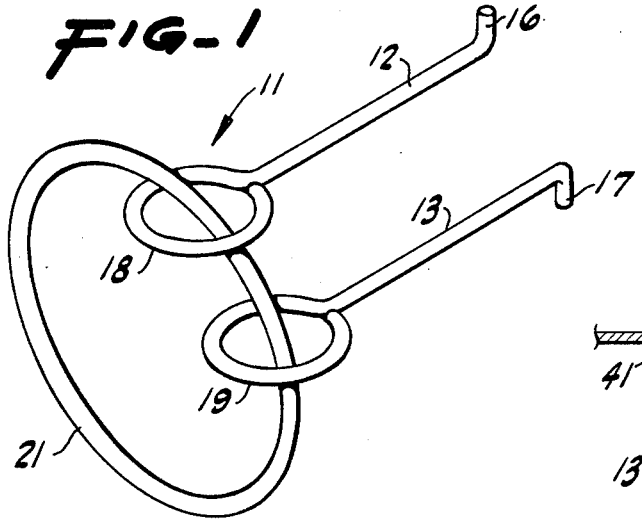
FIG. 1 is a perspective view of a tool in accordance with the present invention.

The present invention is illustrated as to a preferred embodiment thereof in FIG. 1 of the drawings and will be seen to comprise a tool 11 having first and second arms, 12 and 13, formed of high strength material such as steel. The arms 12 and 13 have laterally projecting outer ends 16 and 17, respectively. The inner ends of the arms 12 and 13 are formed into loops 18 and 19, respectively, lying in planes normal to the projections. The arms 12 and 13 may in fact be identical and formed, for example, of square rod.

A further portion of the body puller tool 11 is a ring, 21, which extends through the looped ends 18 and 19 of the arms 12 and 13, as illustrated in FIG. 1. The arms are arranged on the ring 21 in opposition to each other and thus in FIG. 1 it will be seen that the lateral projection 16 and 17 on the arms 12 and 13 extend in opposite directions. The ring 21 is adapted to be engaged by pulling means, as further described below, and the ring is thus formed of a structurally strong material such as steel.

Figure 2:
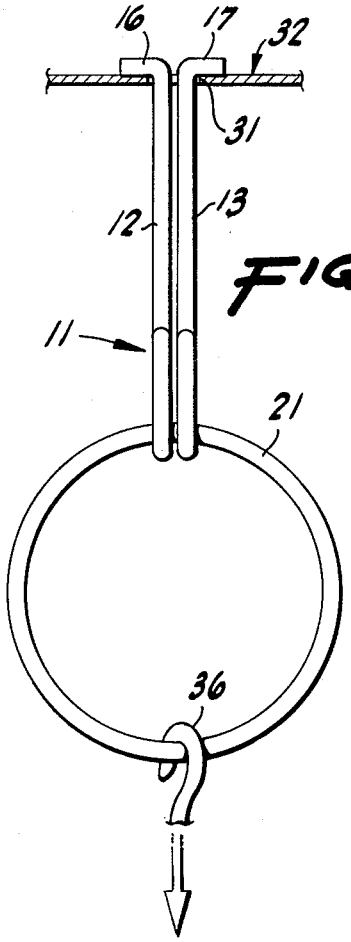
FIG. 2 is a schematic illustration of the tool of FIG. 1 inserted in an aperture for use.
Figure 4:
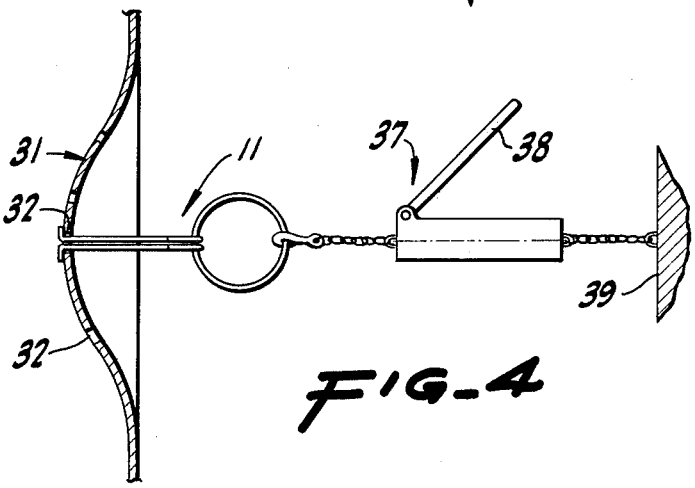
FIG. 4 is a schematic representation of one application of the present invention for removal of a dent in an auto body, for example.

The present invention is adapted to be employed for straightening metal, such as a dented automobile body, by insertion of the hooked arms, 12 and 13, through one or more apertures formed in the metal to be straightened. In this respect reference is made to FIG. 2 of the drawings showing the tool inserted in position for use. A hole, 31, is drilled or otherwise formed in the metal 32 at or near a dented portion thereof to be straightened. The arms 12 and 13 are then inserted in the hole, 31, so as to dispose the laterally projecting ends, 16 and 17 thereof on the opposite side of the metal. The ring 21 is then drawn away from the metal so that the ends 16 and 17 of the arms are pulled against the back surface thereof. As the ring is drawn away from the metal, 32, the looped ends 18 and 19 of the arms ride along the ring until they come into contact with each other. In the illustration of FIG. 2 it will be seen that this then disposes the projections 16 and 17 in opposed alignment, i.e. pointing away from each other. The tool is then ready for use to straighten the metal by applying a force to the ring 21 to pull the metal outwardly by the projection 16 and 17. This force may be applied to the tool in a variety of ways and there is shown in FIG. 2 a hook 36 engaging the ring 21 and attached for example to a "come along" 37 as generally illustrated in FIG. 4 for jacking the tool away from the metal while engaging same. This then will force the metal to move, and assuming that it is anchored, the metal will be bent back toward its original shape.

The tool of the present invention operates to automatically align the L-shaped outer ends of the arms 12 and 13, for example in the manner illustrated in FIG. 2. With this opposed alignment there is then applied a force to the back side of the metal by the tool on both sides of the aperture 31 in the metal. This then provides for a more even application of force and consequently produces the capability of straightening metal with less chance of tearing the metal. It is noted that the L-shaped outer ends of the arms are formed so that pulling upon the ring 21 of the tool will cause flat sides of these projections to bear upon the back surface of the metal, again to minimize local application of forces that might be destructive to the metal.

Figure 3:
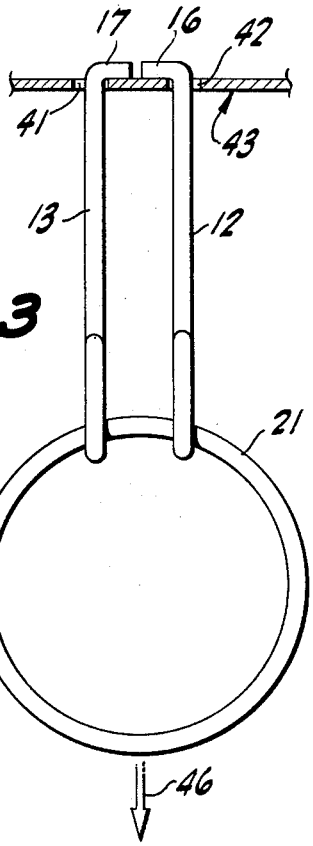
FIG. 3 is a schematic illustration of the tool of FIG. 1 alternatively inserted in a pair of apertures for use.

It will be appreciated from a consideration of the configuration of the present invention that the L-shaped arms of the tool may be oriented as illustrated in FIG. 2 and described above, or the ends of the arms may be directed toward each other. In this respect, reference is made to FIG. 3, illustrating use of the tool with the lateral projections on the ends of the arms directed toward each other. If the arms of the tool, as illustrated for example in FIG. 1, are moved oppositely to each other about the ring 21 until they extend from the bottom of the ring as illustrate in this figure, it will be seen that the projections on the ends of the arms will be directed toward each other. It is this arrangement of the tool that is illustrated in FIG. 3 wherein a pair of holes 41 and 42 are shown to be formed in the piece of metal 43 to be operated upon by the tool. The tool is illustrated prior to applying a force 46 to the ring 21. The end of one of the arms, 12, is inserted in the opening 41 and the end of the other arm 13 is inserted in the opening 42. Pulling on the ring 21 of the tool will then draw the projections 16 and 17 on the arms against the backside of the metal 43 and move the arms 12 and 13 together by sliding the looped ends 18 and 19 thereof along the ring 21 from the position of FIG. 3. This will then cause the projections 16 and 17 to align themselves in facing relationship. The tool is then operated in the manner described above by the application of a force on the ring 21 to pull in a direction away from the metal 43. This will then apply a force to the back side of the metal for moving the metal, or if fixed for removing a dent or the like therein. The application of force in FIG. 3 is indicated by the arrow, 46.

The use of a body puller to straighten metal panels of an automobile, for example, is known in the art, and the present invention may be employed in much the same manner as conventional body pullers but with much less chance of tearing or ripping the metal during straightening thereof. In FIG. 4 there is schematically illustrated a tool 11 in accordance with the present invention, inserted in an opening 32 in a metal sheet 31. The metal 31 may for example, comprise a quarter panel of an automobile which has been dented as indicated, and the back side of which is not accessible for pounding out the dent. A number of holes 32 are normally drilled in the metal and the tool is shown to be inserted in one of the holes for pulling the metal back into original shape. A hook, 36, is placed in engagement with the ring 21 of the tool and attached to a ratchet jacking mechanism such as a "come along" 37, having a handle 38 for drawing the hook 36 toward the mechanism. The jacking unit 37 is secured in position, as for example, by attachment to a fixed structural member generally indicated at 39. By forceably drawing the tool to the right in FIG. 4, it will be seen that the lateral projections 16 and 17 on the arms 12 and 13 respectively will apply a force to the back side of the metal sheet 31 to draw the sheet to the right in FIG. 4. Commonly, a number of holes 32 are drilled in the metal, and the tool 11 moved from one to the other and employed at each of the locations to draw the metal back toward original shape. An application of undue force at any one location can be destructive of the metal although the present invention does minimize the local application of force, particularly as contrasted to conventional body pullers.

It will be seen that the present invention provides an improvement in body pullers by the inclusion of two arms which are automatically aligned in either of the positions illustrated in FIGS. 2 and 3, merely by pulling on the ring of the tool. This automatic alignment feature is, of course, quite important in spreading the force applied by the tool over a larger area of metal for the reasons noted above. It will be appreciated that the physical structure of the present invention may be modified and varied within the scope of the present invention. Thus for example, the arms 12 and 13 may be formed with detachable outer ends, if desired. It is also possible to employ the tool of the present invention with any desired type of apparatus for applying a force thereto, including apparatus for delivering blows. Such apparatus is known in the art and may include a moveable weight, slidable on a shaft for example, until engagement with a shoulder thereon so that attachment of the shaft to the ring of the present invention will allow the application of successive blows to the metal, as transmitted through the arms 12 and 13 of the tool.

Although the present invention has been described above with respect to a single preferred embodiment thereof, it is not intended to limit the invention to the precise terms of description or details of illustration, for it will be apparent to those skilled in the arts that numerous modifications and variations are possible within the scope of the present invention.

What is claimed is:

1. A tool for applying a force to the back side of sheet material having at least one aperture therein comprising a ring, and first and second arms having the inner ends thereof looped about said ring for sliding engagement therewith, said arms each having a lateral projection at the outer end thereof with such projections extending in opposite directions normal to the plane of the looped end of the arm from which the projection extends, whereby insertion of the outer ends of the arms through an aperture in sheet material and pulling said ring away from the material will cause the projections on said arms to rotate into opposed alignment engaging the backside of said material.

2. The tool of claim 1 further defined by said arms each being formed as a single unit of rigid, structurally strong material.

3. The tool of claim 2 further defined by each of said arms having a like rectangular cross section.

4. The tool of claim 1 further defined by said lateral projections each having a least one flat side facing the looped end of the arm from which the projection extends.

5. The tool of claim 1 further defined by said projections extending substantially perpendicularly from said arms.

* * * * *